US006340087B1

(12) United States Patent
Bridges et al.

(10) Patent No.: US 6,340,087 B1
(45) Date of Patent: Jan. 22, 2002

(54) FLAP RETENTION APPARATUS AND METHOD FOR PACKAGING SYSTEMS

(75) Inventors: John William Bridges, Pflugerville; Nancy Shubeck Romano, Austin, both of TX (US)

(73) Assignee: Dell Products, LP., Round Rock, TX (US)

( * ) Notice: Subject to any disclaimer, the term of this patent is extended or adjusted under 35 U.S.C. 154(b) by 0 days.

(21) Appl. No.: 09/650,308

(22) Filed: Aug. 29, 2000

(51) Int. Cl.[7] ..... B65D 81/02

(52) U.S. Cl. ..... 206/523; 206/592; 206/1.5

(58) Field of Search ..... 206/523, 583, 206/585, 587, 590, 591, 592, 521, 1.5, 594

(56) References Cited

U.S. PATENT DOCUMENTS 3,854,650 A * 12/1974 Hanaue ..... 206/523
3,957,196 A * 5/1976 Kellerman ..... 206/586
4,211,356 A * 7/1980 Tsuchiya et al. ..... 206/592
4,368,840 A * 1/1983 Pardo ..... 206/386
4,709,817 A 12/1987 Keady et al.
5,226,542 A 7/1993 Boecker et al.
5,782,354 A 7/1998 Genix
5,806,683 A * 9/1998 Gate ..... 206/587

* cited by examiner

*Primary Examiner*—Shian Luong
(74) *Attorney, Agent, or Firm*—Russell D. Culbertson; Shaffer & Culbertson, LLP

(57) ABSTRACT

A packaging device (1) including a flap retention arrangement (30). The packaging device incorporating the flap retention arrangement (30) includes a panel (22) and a flap member (26). The flap member (26) is connected to the panel (22) and adapted to move between a first position and a second position with respect to the panel (22). The flap retention arrangement (30) includes a retention member (33) and a capture element (37). The retention member (33) is mounted on one of the flap member (26) or the panel (22) while the capture element (37) is located on the other one of the flap member (26) or the panel (22). Regardless of which portion of the flap retention arrangement (30) is mounted on one of the flap member (26) or the panel (22), the retention member (33) and the capture element (37) are situated so as to make contact with each other when the flap member (26) is moved to the second position. This contact retains the flap member (26) in the second position.

19 Claims, 3 Drawing Sheets

FLAP RETENTION APPARATUS AND METHOD FOR PACKAGING SYSTEMS

TECHNICAL FIELD OF THE INVENTION

The present invention generally relates to packaging systems. More particularly, the invention relates to flaps used in packaging systems, and to an apparatus and method for retaining such a flap in a desired position.

BACKGROUND OF THE INVENTION

Computer systems and other electronic systems are commonly shipped as several separate components packaged in a single shipping box or container. The separate components may include the computer chassis and its associated enclosure, a keyboard, a mouse, and system software and documentation. The computer chassis may be loaded into a protective sling within the main box. This sling may have a bottom panel, at least two side panels, and two sling flaps, one sling flap connected to each side panel. The sling flaps fold or pivot with respect to the respective side panel to an open position in which the chassis may be placed in the sling. Once the chassis is loaded, the sling flaps are folded down to a closed position to secure the chassis in a well-protected position in the main box. With the sling flaps folded down, additional padding or spacing elements, or smaller boxes containing the other system components may be placed in the volume of the main box remaining above the sling and previously loaded chassis.

In all packaging systems, particularly computer packaging systems, the speed at which the products may be packaged and readied for shipping is critical. All components of the packaging system, including the main box and any protective sling or other packaging components must be easy to load, close, and seal for shipping. Difficulties or inefficiencies in the packaging system can reduce the number of units which may be packaged and shipped in a given period, and thus reduce overall productivity.

In the situation where a first packaging component, such as a protective sling, is first loaded in a main box, it is important that the flaps associated with the first packaging component be easy to close within the main box. This ability to easily close the flaps is particularly important where additional components are loaded on top of the first packaging component. In the computer packaging system described above, it is important that the flaps of the protective sling be easy to fold down into the closed position to allow the additional components or padding to be quickly added to the main box above the sling. However, problems may arise due to the mechanical resiliency of the sheet of material forming the sling flaps. This mechanical resiliency at the pivot or fold points for the sling flap may cause the flap to return to an open or partially open position after the loader places the flap in the closed position. This open or partially open sling flap position may prevent the additional components or padding from being added quickly to the main box. The loader may be forced to hold the sling flap down with one hand while using the free hand to place additional components or padding in the main box. Having to load the portion of the main box above the protective sling in this one-handed fashion slows the loading process.

For these reasons it is desirable in a packaging system utilizing a sling or similar packaging device to provide some mechanism by which the flap or flaps may be securely retained in the closed position. More specifically, it is desirable to provide a mechanism to prevent the flaps from springing back from the closed position to an open or partially open position.

SUMMARY OF THE INVENTION

It is an object of the present invention to provide a flap retention apparatus and a method for retaining a flap in a desired position with respect to a panel to which the flap is connected. Another object of the invention is to provide a packaging system utilizing a flap retention arrangement.

In accordance with the present invention, a packaging device includes a flap retention arrangement having a retention member and a capture element. The packaging device incorporating the retention arrangement includes a panel and a flap member. The flap member is connected to the panel and adapted to move between a first position with respect to the panel and a second position with respect to the panel. For example, the first position may comprise an open position for the flap member while the second position may comprise a closed position for the flap member. The retention member portion of the retention arrangement is mounted on one of the flap member or panel, while the capture element is located on the other one of the flap member or panel. Regardless of which portion of the retention arrangement is mounted on the flap member or panel, the retention member and capture element are situated so as to make contact with each other when the flap member is moved to the second position. This contact automatically retains the flap member in the second position.

In one preferred form of the invention, the retention member comprises an elongated member mounted on the flap portion of the packaging device. This elongated retention member includes an anchor portion connected to the flap member and a catch portion which extends over an edge of the flap member adjacent to the panel portion of the packaging device. In this preferred form of the invention, the capture element comprises an opening or aperture located in the panel for receiving and engaging the catch portion of the retention member as the flap is moved to the second position with respect to the panel. The elongated retention member may be formed from a resilient material with the catch portion flared outwardly so as to have a transverse dimension larger than a corresponding dimension of the opening making up the capture element. This enlarged catch portion ensures a good frictional engagement between the catch portion and the opening to securely retain the flap member in the second position.

The invention may be incorporated in a packaging system including a container and a sling assembly adapted to be received in the container. One or more side panels may be included in the sling assembly with each side panel having an associated flap which is adapted to fold from an open first position to a closed second position. A separate flap retention arrangement according to the invention may be associated with each panel and flap pair in this container/sling assembly packaging system.

The present flap retention arrangement automatically holds the flap member securely in a desired position with respect to the associated panel. When used in the container/sling assembly packaging system, the flap retention arrangement automatically holds the flap member in the closed second position so that additional packages or packaging material may be easily added to the container portion not occupied by the sling assembly. Yet the present flap retention arrangement may be located on the panel and associated flap member so as not to interfere with the step of loading an object into the sling assembly. Furthermore, the present flap retention arrangement may be easily incorporated into existing sling assembly and other packaging device designs.

These and other objects, advantages, and features of the invention will be apparent from the following description of the preferred embodiments, considered along with the accompanying drawings.

DESCRIPTION OF THE PREFERRED EMBODIMENTS

Figure 1:
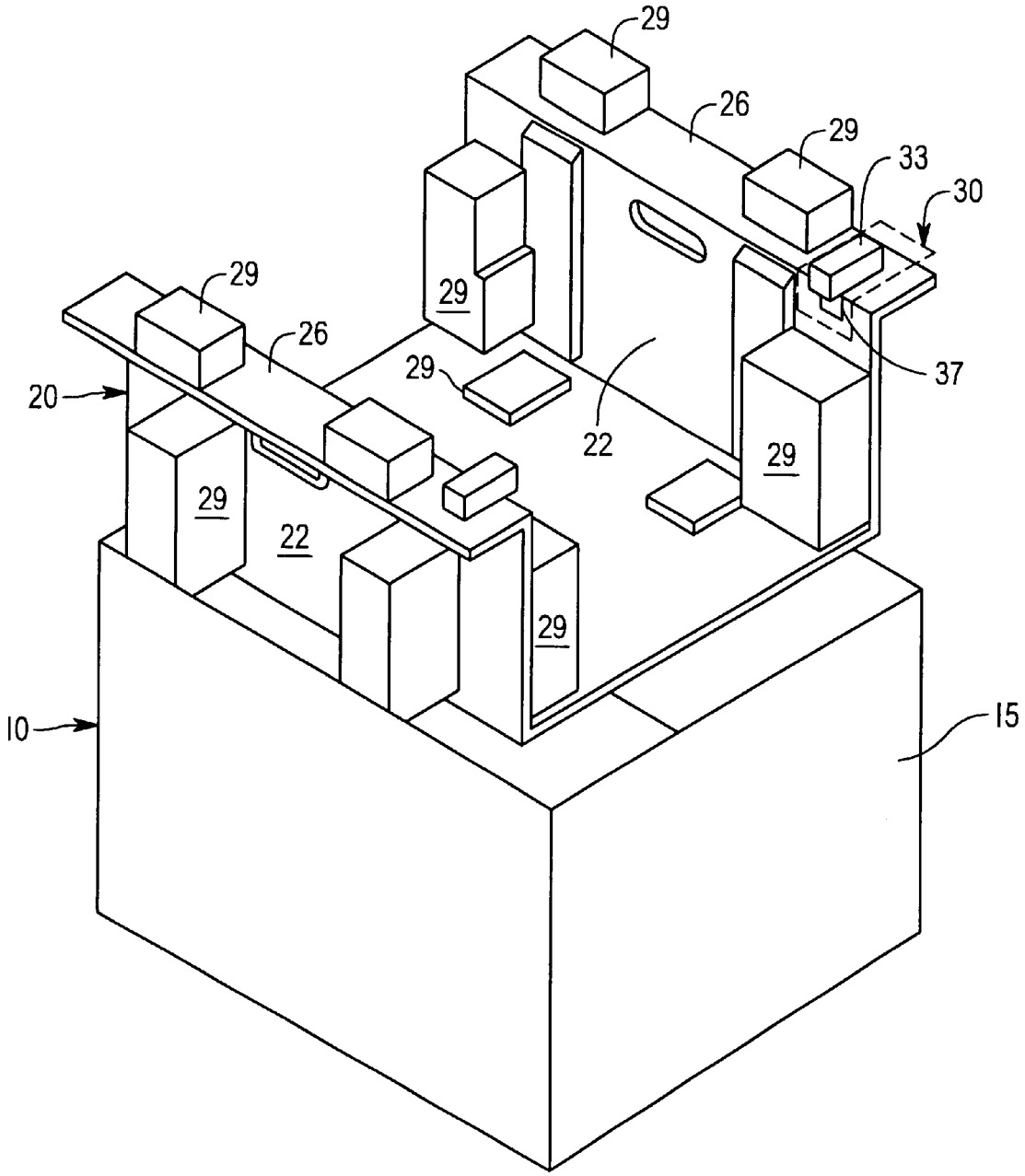
FIG. 1 is an exploded isometric view illustrating a packaging system including a container and a sling assembly, the sling assembly featuring a flap retention arrangement according to one preferred form of the invention.

FIGS. 1–4 illustrate a packaging system 1 including a flap retention arrangement 30 embodying the principles of the invention. The packaging system 1 further includes a container 10 and a sling assembly 20 adapted to be received in the container 10. As discussed in greater detail below, the sling assembly 20 receives an object or objects (hereinafter collectively referred to as "object(s)") within the container 10, and holds the object(s) in a well-protected and stable position within the container. The illustrated sling assembly 20 includes two panels 22, each with a flap member 26. Each flap member 26 is connected to the respective panel 22 and is adapted to move between a first position and a second position with respect to the panel 22.

In the preferred embodiment illustrated in FIGS. 1 through 4, the container 10 comprises a shipment container, such as a shipment container for shipping computer systems. As shown in FIG. 1, the container 10 is defined by a series of walls 15. The container 10 is sufficiently large to enclose the sling 20 and preferably additional packages or objects which may be shipped together. For example, the container 10 may be adapted to contain various components of a computer system such as a computer chassis, a keyboard, mouse, and system documentation (not shown in the figures). The container 10 provides a convenient receptacle for transporting various components together and also protects the various components from the elements.

A separate flap retention arrangement 30 according to the invention is associated with each panel 22 and flap member 26 pair. The flap retention arrangement 30 automatically maintains the flap member 26 in the second position once the flap member 26 is moved to the second position. The flap retention arrangement 30 thus ensures that the flap member 26 retains a desired spatial orientation or position with respect to the respective panel 22.

In addition to its use in a sling assembly, those of ordinary skill in the art will appreciate that a flap retention arrangement according to the invention may be used in any other packaging device which includes a panel with a flap which is adapted to move between various positions with respect to the panel. For example, a flap retention arrangement embodying the principles of the invention may be provided for a flap associated with an outer container such as the container 10.

The sling assembly 20 includes at least one spacer element 29, and preferably several spacer elements 29 arranged about the sling assembly. The spacer elements 29 help hold object(s) in a desired position within the sling assembly 20 and also function to hold the sling assembly itself in a desired position with in the container 10.

As indicated in FIG. 1, the sling assembly 20 includes a single piece of material, such as corrugated cardboard for example, folded to form the panels 22 and flaps 26. The respective flap member 26 may pivot with respect to the respective panel 22 by folding along a fold line 21 shown in FIG. 1. The fold line 21 thus forms a pivot connection between the respective flap 26 and panel 22. Other embodiments of the invention contemplate the panels 22 and flaps as a separate members that are connected together to form the sling assembly 20. For example, the panels 22 may be connected to a bottom member of the sling assembly by adhesive tape, a hinge, or a mortise and tenon joint. Each flap 26 may be connected to the respective panel 22 by adhesive tape, a hinge, or any other structure which enables the flap to pivot with respect to the respective panel from a first position to a second position.

Figure 2:
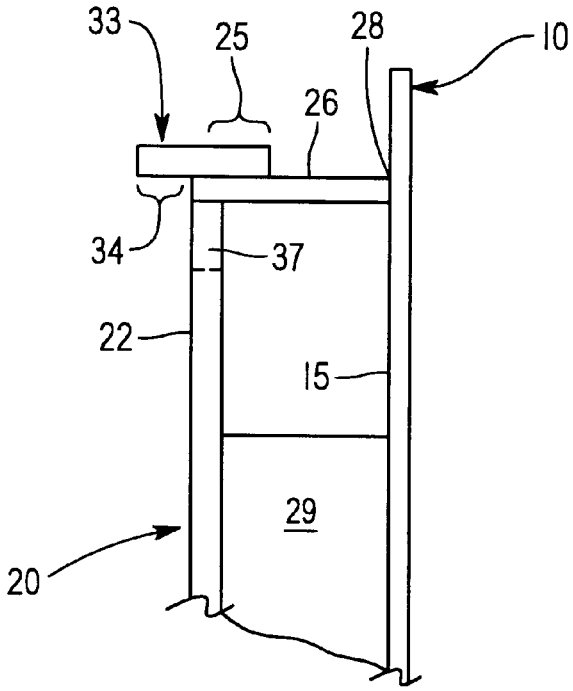
FIG. 2 is a partial side view illustrating the flap retention arrangement of FIG. 1, with the flap in a first or open position.
Figure 3:
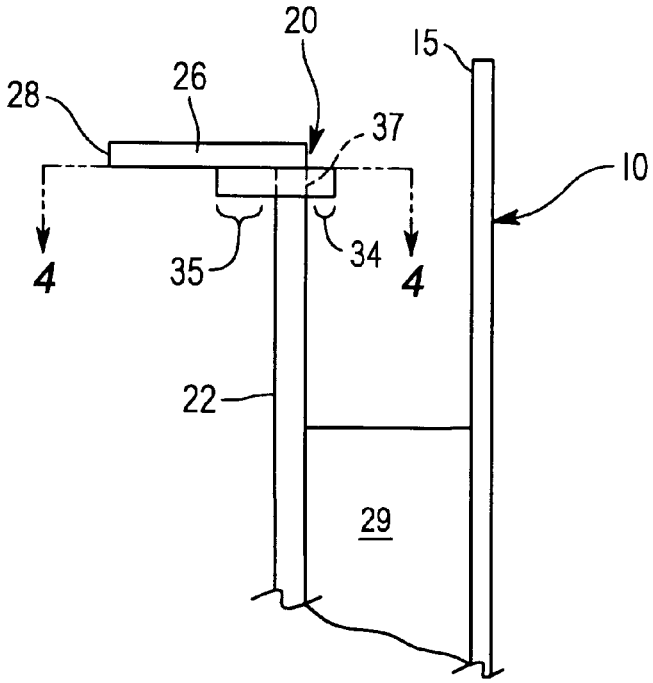
FIG. 3 is a partial side view similar to FIG. 1, but with the flap moved to a second or closed position.

FIGS. 2 and 3 show a top portion of one side of the sling assembly 20, with the sling assembly received in the container 10. In a first or open position shown in FIG. 2, the flap member 26 is arranged for allowing object(s) to be loaded into the sling assembly 20 within the container 10. In the preferred form of the invention shown in FIG. 2, the flap member 26 is so dimensioned as to contact the container wall 15 when in the first position. Specifically, the flap member 26 includes a gripping edge 28 which frictionally engages the container wall 15 when the flap member 26 is in the first position shown in FIG. 2. This frictional engagement with container wall 15 holds the flap member 26 in the open, first position.

FIG. 3 shows the flap member 26 arranged in the second position. In this second position the flap member 26 extends perpendicular to the panel 22 over a top opening of the sling assembly 20 in position to secure object(s) within the sling assembly 20. In the illustrated form of the invention, the flap retention arrangement 30 (FIG. 1) is adapted to retain the flap member 26 in this second or closed position shown in FIG. 3.

As shown in FIGS. 1 through 4, the flap retention arrangement 30 includes a retention member shown generally at reference numeral 33 and a capture element shown at reference numeral 37. The retention member 33 and capture element 37 make contact with each other when the flap member 26 is in the second position shown in FIG. 3, and this contact holds the flap member in the second position.

Figure 4:
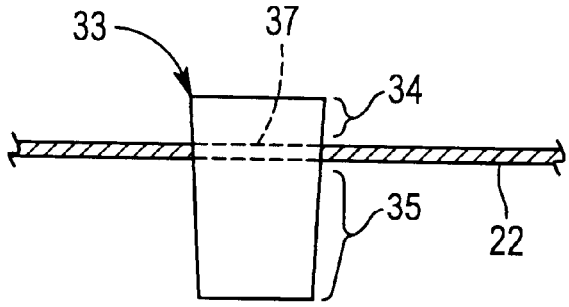
FIG. 4 is a partial section view through line 4—4 in FIG. 3 showing the engagement between the retention member and capture element.

As shown best in FIGS. 2 through 4, the retention member 33 preferably comprises an elongated member with a catch portion 34 and an anchor portion 35. The anchor portion 35 is secured to the flap member 26, whereas the catch portion 34 extends outwardly from the anchor portion 35 and a peripheral edge of the flap member 26. In the preferred embodiment, the retention member 33 is composed of a resilient foam material although any suitable material may be used.

The preferred capture element 37 comprises an opening located on the panel 22 of the sling assembly 20. The opening comprising capture element 37 is adapted to receive at least part of the catch portion 34 of the retention member 33 when the flap member 26 is in the second position. That is, the opening comprising the capture element 37 is located on the panel 22 and sized so that when the flap member 26 is moved to the second position, at least part of the periphery of the opening engages the peripheral surface of the catch portion 34. This contact between the catch portion 34 and the capture element 37 holds the flap member 26 in a fixed position with respect to the panel 22. Thus, the flap member 26 remains in the second position until intentionally repositioned with sufficient force to disengage the catch portion 34 from the capture element 37.

In order to provide the desired frictional engagement between the catch portion 34 and the opening comprising the capture element 37, the catch portion includes a transverse dimension at least equal to a corresponding dimension of the opening. In the preferred form of the invention in which the catch portion 34 is made of a resilient material, the catch portion 34 has a transverse dimension somewhat greater than a corresponding dimension of the opening comprising the capture element 37. This larger transverse dimension of the catch portion ensures good frictional engagement with the capture element opening 37. Preferably, the catch portion 34 tapers from a narrower transverse dimension to a wider transverse dimension toward a distal end 39 of the catch portion 34 as shown in FIG. 4.

Figure 5:
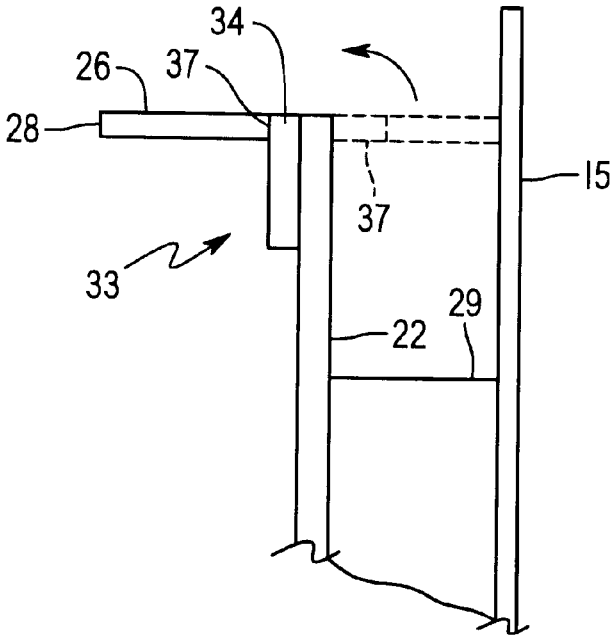
FIG. 5 is a partial side view of a panel and flap along with an alternate form of the invention.

FIG. 5 shows an alternate form of the invention in which the positions of the retention member 33 and capture element 37 are switched with respect to the embodiment shown in FIGS. 1 through 4. In this alternate form of the invention the retention member 33 is connected to the panel 22 while the capture element is located on the flap member 26. The first position of the flap 26 member is shown in phantom lines in FIG. 5 and the second or closed position of the flap member 26 is shown in solid lines. As the flap member 26 is pivoted from the open position to the second position, the catch portion 34 of the retention member 33 extends into and engages the opening comprising the capture element 37 on the flap member 26. This engagement between the retention member 33 and capture element 37 holds the flap member 26 in the second position.

In either the form of the invention shown in FIGS. 1 through 4 or the form shown in FIG. 5, it is important that the retention member be positioned in a location in which it does not interfere with either the loading of the sling assembly 20 or the closure of the flap member 26 over an object received in the sling assembly 20. Thus, as noted from FIGS. 1 through 4, the retention member 33 is located near one side of the flap member 26. In this position, the catch portion 34 of the retention member 33 does not interfere with an object being loaded into the sling assembly 20. Furthermore, an object properly received in the sling assembly 20 will not contact and interfere with the retention member 33 as the flap member 26 is moved to the second position shown in FIG. 3. The retention member 33 in the form of the invention shown in FIG. 5 may similarly be located near a side of the panel 22 on which it is mounted. This position form the retention member 33 prevents the member from interfering with an object being loaded into the sling assembly 20.

Although the illustrated form of the invention relies on frictional engagement between the retention member 33 and the capture element 37, the invention encompasses other types of engagement. In another alternate embodiment of the retention arrangement 30, a hook and loop type connector such as a VELCRO brand connector is employed to provide the desired engagement between the retention member 33 and the capture element 37. Specifically, one half of the hook and loop type connector, the hook members for example, may be positioned on the distal end of catch portion 34. The other half of the hoop and loop type connector is positioned on the panel 22 or flap member where the capture element opening is positioned on the illustrated embodiments. In this alternate form of the invention, the hook and loop connector components make contact when the flap member 26 is moved to the closed, second position and this contact automatically holds the flap in the closed position.

Although the present invention has been described in terms of the foregoing embodiments, such description has been for exemplary purposes only. As will be apparent to those of ordinary skill in the art, many alternatives, equivalents, and variations of varying degrees will fall within the scope of the present invention as defined by the following claims.

What is claimed is:

1. A packaging device including:

(a) a panel;

(b) a flap member pivotally connected to the panel, the flap member movable between a first position with respect to the panel and a second position with respect to the panel;

(c) a retention member mounted on one of the flap member or the panel, a portion of the retention member extending over a peripheral edge of the one of the flap member or panel on which the retention member is mounted; and (d) a capture element located on the other one of the flap member or the panel, the retention member and capture element making contact when the flap member is in the second position to retain the flap member in the second position.

2. The packaging device of claim 1 wherein the retention member is mounted on the flap member and the capture element is located on the panel.

3. The packaging device of claim 2 wherein:

(a) the retention member comprises a member including an anchor portion and a catch portion; and (b) the capture element comprises an opening in the panel for receiving and engaging the catch portion of the retention member.

4. The packaging device of claim 3 wherein the catch portion of the retention member is made of a resilient material having a transverse dimension larger than a corresponding dimension of the opening comprising the capture element.

5. The packaging device of claim 3 wherein the anchor portion of the retention member is mounted on an inner side of the flap member and the catch portion of the retention member extends from an edge of the flap member which is pivotally connected to the panel.

6. The packaging device of claim 1 wherein the flap member comprises a substantially planar member and extends generally perpendicular to the panel when in the second position.

7. The packaging device of claim 1 wherein:

(a) the flap member comprises a top flap on a sling assembly adapted to be received in a shipping container; and (b) the panel comprises a side panel of the sling assembly.

8. A packaging system including:

(a) a container;

(b) a sling assembly adapted to be received in the container, the sling assembly for receiving an object to be shipped in the container and for supporting the object in a desired position within the container;

(c) a panel included in the sling assembly;

(d) a flap member included in the sling assembly, the flap member being connected to the panel and adapted to move between a first position with respect to the panel and a second position with respect to the panel;

(e) a retention member mounted on one of the flap member or the panel, the retention member extending over a peripheral edge of the one of the flap member or panel member on which the retention member is mounted; and (f) a capture element located on the other one of the flap member or the panel, the retention member and capture element making contact when the flap member is in the second position to retain the flap member in the second position.

9. The packaging system of claim 8 wherein the retention member is disengaged from the capture element when the flap member is in the first position.

10. The packaging system of claim 8 wherein the retention member is mounted on the flap and the capture element is located on the panel.

11. The packaging system of claim 10 wherein the retention member comprises an elongated member having an anchor portion connected to the flap member and a catch portion extending from an edge of the flap member.

12. The packaging system of claim 11 wherein the capture element comprises an opening located on the panel, the opening adapted to receive at least part of the catch portion of the retention member when the flap member is in the second position with at least part of the periphery of the opening engaging parts of the catch portion.

13. The packaging system of claim 12 wherein the catch portion of the retention member is made from a resilient material having a transverse dimension greater than a corresponding dimension of the opening comprising the capture element.

14. The packaging system of claim 13 wherein the retention member comprises an elongated piece of foam material.

15. The packaging system of claim 13 wherein the transverse dimension of the catch portion tapers from a narrower dimension to a wider dimension toward a distal end of the catch portion.

16. A method for retaining a planar flap member of a packaging device in a desired position extending substantially perpendicular with respect to a planar panel of the packaging device, the method including the steps of:

(a) moving the flap member to the desired position with respect to the panel; and (b) extending a retention member mounted on the flap member into engagement with a capture element as the flap member is moved to the desired position with respect to the panel, the capture element residing substantially in the plane of the panel and the engagement retaining the flap member in the desired position.

17. The method of claim 16 wherein the step of moving the flap member to the desired position with respect to the panel comprises pivoting the flap member about a pivot connection with the panel.

18. The method of claim 16 wherein the step of extending the retention member into engagement with the capture element includes the step of inserting a catch portion of the retention member into an opening located on the panel.

19. The method of claim 18 wherein part of the retention member makes contact with part of the periphery of the opening on the panel.

* * * * *